US009127419B2

(12) United States Patent
Robinson

(10) Patent No.: US 9,127,419 B2
(45) Date of Patent: Sep. 8, 2015

(54) VEHICLE MOUNTED APPARATUS FOR HIGH-PRESSURE FLUID BLASTING

(75) Inventor: Stephen Holmes Robinson, Wellington (NZ)

(73) Assignee: AQUAMAX-DEVCO LIMITED, Wellington (NZ)

( * ) Notice: Subject to any disclaimer, the term of this patent is extended or adjusted under 35 U.S.C. 154(b) by 389 days.

(21) Appl. No.: 13/518,543

(22) PCT Filed: Dec. 23, 2010

(86) PCT No.: PCT/NZ2010/000262

§ 371 (c)(1), (2), (4) Date: Jun. 22, 2012

(87) PCT Pub. No.: WO2011/078705

PCT Pub. Date: Jun. 30, 2011

(65) Prior Publication Data

US 2012/0255578 A1 Oct. 11, 2012

(30) Foreign Application Priority Data

Dec. 24, 2009 (NZ) ..... 582381

(51) Int. Cl.

| | |
|---|---|
| ***E01C 23/12*** | (2006.01) |
| ***B08B 3/02*** | (2006.01) |
| ***B08B 5/04*** | (2006.01) |
| ***E01C 23/08*** | (2006.01) |
| ***E01H 1/10*** | (2006.01) |

(52) U.S. Cl.

CPC ..... *E01C 23/12* (2013.01); *B08B 3/024* (2013.01); *B08B 5/04* (2013.01); *E01C 23/08* (2013.01); *E01C 23/128* (2013.01); *E01H 1/103* (2013.01)

(58) Field of Classification Search

CPC ..... E01C 23/08; E01C 23/12; E01C 23/128; E01H 1/103; B08B 5/04; B08B 3/024

USPC ..... 134/184

See application file for complete search history.

(56) References Cited

U.S. PATENT DOCUMENTS

| | | | | |
|---|---|---|---|---|
| 4,377,018 | A * | 3/1983 | Cain | 15/322 |
| 4,827,559 | A | 5/1989 | Norland | |
| 5,333,969 | A * | 8/1994 | Blaha et al. | 404/91 |
| 6,179,519 | B1 * | 1/2001 | Hilmersson | 404/91 |
| 7,290,307 | B1 * | 11/2007 | Chao | 15/322 |

(Continued)

OTHER PUBLICATIONS

International Search Report and Written Opinion dated May 16, 2012 from PCT/NZ2010/000262.

*Primary Examiner* — Jason Ko
*Assistant Examiner* — Spencer Bell
(74) *Attorney, Agent, or Firm* — Ohlandt Greeley Ruggiero & Perle L.L.P.

(57) ABSTRACT

A vehicle mounted apparatus for high-pressure fluid blasting to remove material from or otherwise treat a surface, the apparatus comprising: a high-pressure fluid supply connected to a nozzle assembly containing at least one nozzle, the nozzle assembly being supported for movement along a track mounted transversely on the vehicle; and a suction device for conveying airflow and removed material through a conduit from the nozzle assembly to a treatment zone within the vehicle, the treatment zone having a separation means for accumulating removed material, a means for conveying airflow from the separation means to the suction device, and a means for conveying the removed material to a storage zone.

21 Claims, 10 Drawing Sheets

(56) References Cited

U.S. PATENT DOCUMENTS

| | | | | |
|---|---|---|---|---|
| 8,051,529 | B2 | 11/2011 | Shea | |
| 2005/0172583 | A1* | 8/2005 | Wydra et al. | 55/337 |
| 2006/0197344 | A1* | 9/2006 | Henry | 285/420 |
| 2007/0169305 | A1* | 7/2007 | Shea | 15/320 |
| 2009/0052986 | A1* | 2/2009 | Hall et al. | 404/90 |
| 2009/0241999 | A1* | 10/2009 | Crocker | 134/111 |

* cited by examiner

PERSPECTIVE VIEW

FRONT VIEW

SIDE CROSS-SECTIONAL VIEW

VEHICLE MOUNTED APPARATUS FOR HIGH-PRESSURE FLUID BLASTING

BACKGROUND

1. Field of the Invention

The present disclosure relates to a vehicle mounted apparatus for use in high-pressure fluid blasting, and in particular, to an apparatus that is suitable for mounting onto a truck for removing material from a road, airport runway, or other paved surface. The apparatus is particularly suitable for removing bitumen.

2. Discussion of the Background Art

High-pressure fluid blasting systems, and in particular water blasting systems, are used in a variety of situations for cleaning or otherwise treating surfaces. The treatment may be a conditioning treatment, in which material, such as tar bleed, is removed from the upper surface of a road or other paved surface so as to recondition the surface in order to extend the safe useable lifetime of the surface. Surface treatment may also involve the removal of painted road markings and lines or may involve the more radical cutting or removal of material for example in order to re-lay the surface.

The roading systems of many countries, including Australia and New Zealand, use chip sealing to provide waterproof, flexible and reliable road surfaces for wheeled vehicles. Chip sealing is a method of sealing a road in which a layer of bitumen based binder is applied to the road bed followed by a layer of stone chips. The surface of the road is then rolled to embed the stone chips into the binder. Chip sealed roads can require resurfacing for a multitude of reasons. For example, 'flushing' describes the smooth surface of a road caused by excess binder rising to the surface. This can occur as a result of the stone chips being forced into a soft substrate under the wheels of vehicles. The occurrence of flushing has to be immediately rectified to ensure optimal road surface texture and to maintain vehicle safety.

In order to repair the surface of a road that has undergone flushing, it is known to use high-pressure water blasters to remove the bitumen based binder from the road so that the road can be resealed. Bitumen is an extremely adhesive material which in its stabilised form is highly viscous and almost solid. In a chip sealed road, the uppermost bitumen is toughened and the underlying bitumen remains in a viscous state. After being released from the road, the freed bitumen particles retain their full adhesion properties. The exceptional adhesion properties of bitumen combined with its high or low viscosity create significant difficulties for transporting the material through enclosed mediums for storage in a holding tank without residue or blockage occurring.

At least two different water blasting arrangements are known. The most common arrangement involves a high-pressure/high-volume water blasting arrangement. However, such arrangements have proven to be unreliable, especially in the area of surface reconditioning and tar bleed removal and suffer a significant disadvantage in that very high volumes of waste water and wetted waste material removed from the road surface need to be disposed of. Because of contamination of the treatment water, the water and removed material must be removed from the treatment site and disposed of in a sanctioned waste area. The removal of such large amounts of waste material and contaminated water has, until now, involved the use of very large vacuum devices operating with internal storage capacity or separate disposal trucks. As these trucks must frequently visit an approved disposal site, the equipment is prone to long downtimes. In addition, when treating roads in remote areas, large volumes of water may not be immediately available and the transportation of large volumes of water significantly increases operational costs.

An alternative approach to road and pavement surface treatment has been developed by the applicant and involves the use of ultra high-pressure/low-volume fluid blasting. This fluid blasting unit operates at pressures in the region of 40,000 psi (2,800 bar) but with flow rates as low as 3.5 to 4.5 liters/min. However, even with significantly reduced flows, the UHP/LV system still requires the safe and environmentally acceptable removal of waste products.

It is an object of the present disclosure to provide a vehicle mounted apparatus that at least mitigates some of the problems associated with the prior art.

SUMMARY

According to a first aspect of the disclosure, there is provided a vehicle mounted apparatus for high-pressure fluid blasting to remove material from or otherwise treat a surface, the apparatus comprising: a high-pressure fluid supply connected to a nozzle assembly containing at least one nozzle, the nozzle assembly being supported for movement along a track mounted transversely on the vehicle; and a suction device for conveying airflow and removed material through a conduit from the nozzle assembly to a treatment zone within the vehicle, the treatment zone having a separation means for accumulating removed material, a means for conveying airflow from the separation means to the suction device, and a means for conveying the removed material to a storage zone.

Optionally, the nozzle assembly is surrounded by a shroud having one or more suction inlet ports for the entry of air, fluid, and released material. In one embodiment, the shroud has an open end and a closed end, the open end having an outwardly extending annular rim. Conveniently the shroud can rotate the nozzle assembly at an adjustable rpm speed and/or adjust the distance between the nozzle assembly and the surface being blasted.

In one embodiment, the shroud comprises an external housing, an insert, and an inner housing, the external housing comprising a cylindrical structure with an open end and a closed end, the open end having an outwardly extending annular rim, the insert comprising a correspondingly shaped cylindrical structure with an open end and a closed end, the closed ends of the external housing and the insert both containing apertures that cooperate, once the insert and the external housing are engaged, to form an opening for the inner housing supporting the nozzle assembly, as well as apertures that cooperate to form one or more suction inlet ports, preferably two suction inlet ports.

Conveniently the interior surfaces of the shroud are shaped to form at least a first zone and a second zone. In the first zone, located close to the open end of the shroud, the interior walls of the shroud are substantially perpendicular to the rim to create lift for the mixture of air, fluid and released material. In the second zone, located close to the closed end of the shroud, the interior walls of the shroud are angled towards the one or more suction inlet ports to direct the mixture into the one or more ports.

The shroud may be made of any suitable material such as steel or hard silicone, and is advantageously coated with a liquid silicone based composition, such as silicone based paint, to discourage removed material such as bitumen, from adhering to the shroud.

Conveniently the nozzle assembly is supported by a carriage for movement along the track. The carriage may move along the track by means of a friction drive, caterpillar track, rack and pinion, or any other suitable means. In one embodiment, the track is linear and comprises an upper edge surface, a lower edge surface, and first and second opposed lateral surfaces, each lateral surface presenting two elongate drive regions, each extending substantially the length of the track, separated by a guide element, the carriage supporting at least first and second roller elements to be positioned on opposite sides of the track, the first roller element being adapted in a drive position to engage the first lateral surface and the second roller element being adapted, in the drive position, to engage the second lateral surface, each roller element shaped to provide two drive surfaces separated by a guide surface, the drive surfaces being adapted to cooperate with respective drive regions of the track so that rotation of the roller elements will cause the carriage to move along the track, the guide surface cooperating with the guide element on the corresponding lateral surface of the track; the carriage containing a drive means to drive at least one of the roller elements and a biasing means to move the opposed roller elements between a released position in which the carriage can be removed from the track, and the drive position abutting the track, the carriage providing a mounting surface for the nozzle assembly.

The guide elements may be substantially convex. In one embodiment, the guide elements are generally D-shaped. Advantageously one or more spacer elements are provided to space the guide elements from the lateral surface of the track.

The guide surface of each roller element may be substantially concave. In one embodiment, each roller element has a generally hourglass shape, having substantially cylindrical end parts connected by a concave central region, with the surface of each cylindrical end part providing a drive surface and the concave portion between the end parts providing the guide surface. Advantageously each end part is provided with at least one O-ring to improve the drive connection between the roller element and the track.

The carriage may have any number of roller elements, preferably between two and eight roller elements. The number of roller elements for engaging the first lateral surface of the track is preferably equal to the number of roller elements for engaging the second lateral surface of the track. In one embodiment, there are two roller elements for engaging the first lateral surface and two roller elements for engaging the second lateral surface.

The drive means may comprise a motor, such as an electric, pneumatic or hydraulic motor, and one or two drive belts. Where there is one drive belt, the drive means may cause the roller elements engaged with one lateral surface of the track to roll in either longitudinal direction along the track. Where there are two drive belts, the drive means may cause the roller elements engaged with the first lateral surface of the track to roll in one longitudinal direction and cause the roller elements engaged with the second lateral surface of the track to roll in the opposite direction.

In another embodiment, the carriage may be fixed and the track unfixed. The track is then driven by the fixed but rotating roller elements. Thus, the track will move in a linear motion rather than the rollers.

Advantageously the motor may be operated by remote control and may be powered by a battery, for example, a rechargeable battery. The motor may be controlled by a microprocessor, such as a computer, in order to control the direction and/or speed of the carriage. The microprocessor may be programmed to move the carriage along the track in a specific movement or series of movements.

The track may be mounted at any location on the vehicle. In an embodiment where the nozzle assembly is for use in blasting the surface of a road or other paved surface, for example, to remove bitumen or road markings, the track may be mounted along the width of a road vehicle, such as the front of a truck, with the nozzle assembly attached to the carriage. In one embodiment the track consists of connectable sections of rail which extend beyond the width of the vehicle to, for example, allow the nozzle assembly to blast the surface of footpaths. The movement of the carriage along the track may be controlled by a microprocessor inside the vehicle, for example, inside the cab of the truck, or via a portable control system operated by a person outside the vehicle. The microprocessor may coordinate the movement of the carriage with the forward/rearward travel of the vehicle, for example, to control the rate at which the nozzle assembly moves across the width of the road as the vehicle moves along the length of the road.

The conduit may be one or more hollow elongate tubes, such as a cylindrical hose or pipe. In an embodiment where the nozzle assembly is surrounded by a shroud, the conduit may engage a suction inlet port in the shroud or, in the case of a shroud with two suction inlet ports, have a bifurcated end which engages both suction inlet ports.

In one embodiment, the conduit comprises at least one pipe consisting of two half sections with a lockable hinge member located within the wall of the pipe to assist in the removal of any blockage. Advantageously the conduit may be made of steel or hard silicone and the interior preferably coated with a liquid silicone based composition, such as silicone based paint, to discourage removed material such as bitumen from adhering to the inside of the conduit and creating a blockage. The exterior of the conduit may be covered with a 'heat sink' material, such as a water jacket, in order to reduce the temperature inside the conduit to further decrease the adhesive properties of material, such as bitumen, passing through the conduit.

In one embodiment, the separation means comprises a separator having an inlet located in an upper region which directs the airflow, fluid and removed material at a deflector, the impact with the deflector directing the material and fluid to a collection zone at the base of the separator for removal, the separator having an air outlet connected to the suction device.

In a particular embodiment, the separator contains a first and second separation chamber, each chamber having a hollow rectangular or cylindrical cross section and a cone shaped base with a valve located in the centre of the base, the base of the first chamber forming a roof for the second chamber so that material in the first chamber can pass into the second chamber when the valve between the two chambers is open, the inlet and the air outlet both being located in the first chamber, the deflector comprising a curved barrier which extends from above the inlet to a position in the interior of the chamber below the inlet. Preferably the two valves are flap valves which are opened or closed by an air ram and conveniently controlled by a microprocessor programmed to open only one valve at a time.

Advantageously the two valves and the interior of the separator, particularly the deflector, is coated with a liquid silicone based composition, such as silicone based paint, to ensure that material such as bitumen does not adhere to the interior surfaces. Usefully the separator has an additional cooling system for reducing the temperature inside the chamber to assist in removing fluid vapour from the airflow.

The storage zone preferably comprises an open, porous sack for the collection of removed material and fluid from the separation means. Advantageously, a new sack is automatically opened and moved into position by a trolley arm approximately every 10-20 minutes during the operation of the apparatus. In a particular embodiment, there is located underneath the sack, a means for collecting the fluid passing through the sack so that the fluid can be recycled and returned to the fluid supply. The collecting means may be a stainless steel tray.

Conveniently, the apparatus includes an assessment zone in which water vapour in the airflow is condensed and one or more sensors enable details of the airflow to be monitored. More conveniently the one or more sensors monitor pressure, temperature, moisture, and airflow fluctuations. Most conveniently the assessment zone also includes a microprocessor to compare the measurements taken from the one or more sensors with normal ranges in order to determine whether there is a blockage in the apparatus and, if so, activate a pre-programmed response.

As indicated above, the apparatus is particularly suitable for use with ultra high-pressure/low-volume water blasting systems of at least 35,000 psi and between 3.5 and 4.5 liters/minute. Optionally, the water may contain one or more surfactants.

One embodiment of the disclosure is for use in removing bitumen from roads.

According to a second aspect of the disclosure, there is provided a method for high-pressure fluid blasting to remove material from a surface, the method comprising: connecting a high-pressure fluid supply to a nozzle assembly containing at least one nozzle, moving the nozzle assembly along a track mounted transversely on a vehicle; and using a suction device to convey airflow and removed material through a conduit from the nozzle assembly to a treatment zone within the vehicle, the treatment zone having a separation means for accumulating removed material, a means for conveying airflow from the separation means to the suction device, and a means for conveying the removed material to a storage zone.

In an embodiment where the nozzle assembly is used to blast the surface of a road or other paved surface, for example, to remove bitumen or road markings, the track may be mounted along the width of a road vehicle, such as the front of a truck, with the nozzle assembly attached to a carriage arranged for movement along the track. The movement of the carriage along the track may be driven by a motor, such as an electric, pneumatic or hydraulic motor, controlled by a microprocessor inside the vehicle, for example, inside the cab of the truck, or via a portable control system operated by a person outside the vehicle. The microprocessor may coordinate the movement of the carriage with the forward/rearward travel of the vehicle, for example, to control the rate at which the nozzle assembly moves across the width of the road as the vehicle moves along the length of the road.

The method is particularly suitable for use with ultra high-pressure/low-volume water blasting systems of at least 35,000 psi and between 3.5 and 4.5 liters/minute. Optionally, the water may contain one or more surfactants. The method can be used to blast a paved surface, such as a road, carpark or runway. A preferred embodiment of the method is suitable for removing bitumen from a road.

According to a third aspect of the disclosure, there is provided a shroud to surround a nozzle assembly for high-pressure blasting of a surface, the shroud having an open end and a closed end, the open end having an outwardly extending rim arranged to be parallel to the surface being blasted. Ideally the outer rim will be held close to but separated from the surface during operation.

The closed end of the shroud may have one or more suction inlet ports for the entry of air, fluid, and released material. Advantageously, the shroud can adjust the distance between the nozzle assembly and the surface being blasted.

In one embodiment, the shroud comprises an external housing, an insert, and an inner housing, the external housing comprising a cylindrical structure with an open end and a closed end, the open end having an outwardly extending annular rim, the insert comprising a correspondingly shaped cylindrical structure with an open end and a closed end, the closed ends of the external housing and the insert both containing apertures that cooperate, once the insert and the external housing are engaged, to form an opening for the inner housing supporting the nozzle assembly, as well as apertures that cooperate to form one or more suction inlet ports.

The interior surfaces of the shroud may be shaped to form at least a first zone and a second zone. The first zone may be located close to the open end of the shroud, the interior walls of the shroud in the first zone being substantially perpendicular to the rim to create lift for the mixture of air, fluid and released material, the second zone may be located close to the closed end of the shroud, the interior walls of the shroud in the second zone being angled towards the one or more suction inlet ports to direct the mixture into the one or more ports.

BRIEF DESCRIPTION OF THE DRAWINGS

In order that the disclosure may be more readily understood, and so that further features thereof will be appreciated, a preferred embodiment of the apparatus for high-pressure fluid blasting will now be described, by way of example only, with reference to the accompanying drawings in which.

DETAILED DESCRIPTION OF THE PREFERRED EMBODIMENT

Figure 1:
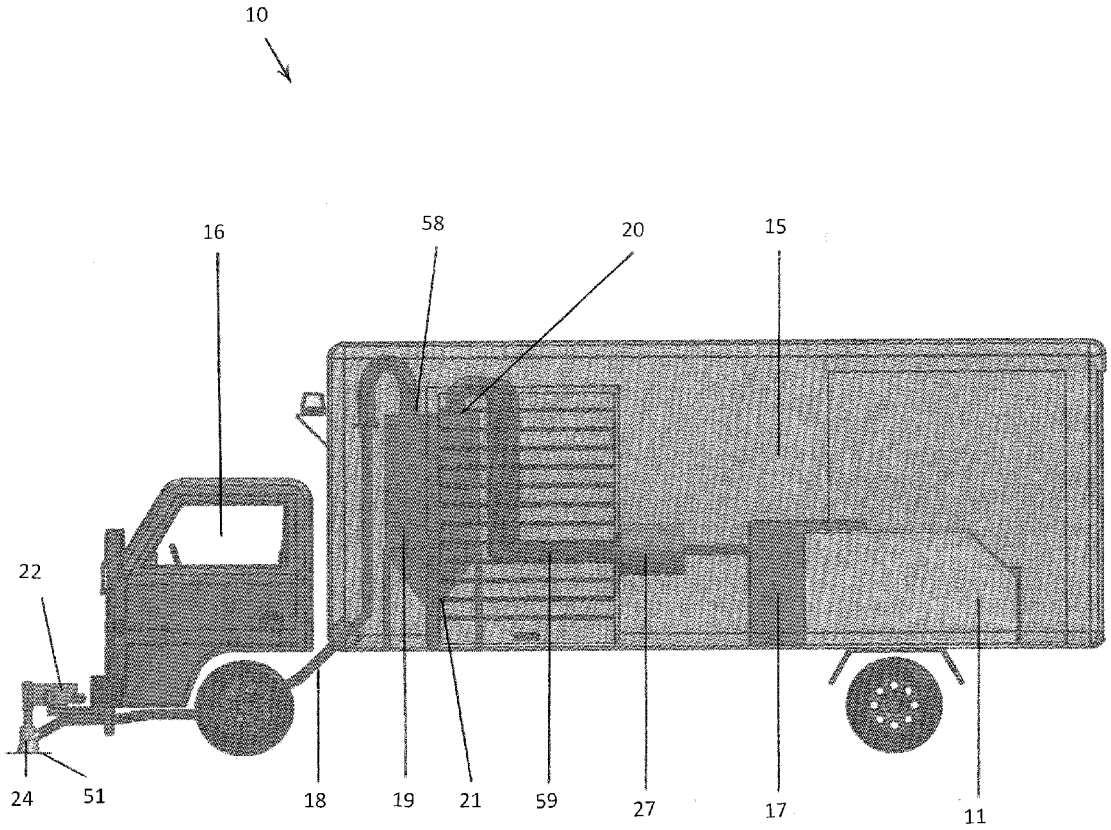
FIG. 1 is a side view of the apparatus mounted onto a truck.
Figure 2:
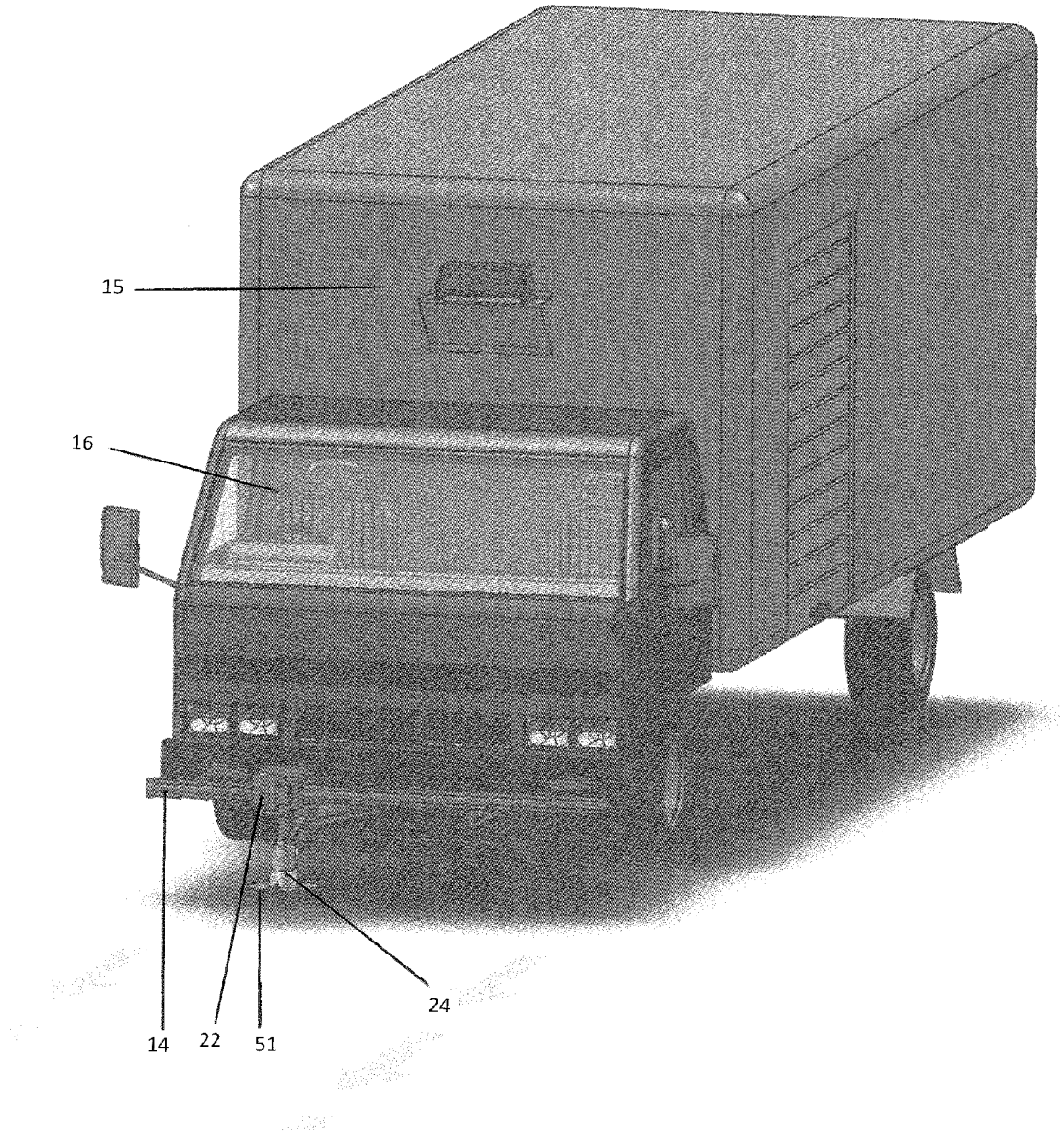
FIG. 2 is a front perspective view of the truck of FIG. 1.

Referring to the drawings, the disclosure relates to a vehicle mounted apparatus, indicated generally as 10, for high-pressure fluid blasting to remove material from a surface, the apparatus comprising: a high-pressure fluid supply 11 connected to a nozzle assembly 12 containing at least one nozzle 13, the nozzle assembly being supported for movement along a track 14 mounted transversely on the vehicle 15; and a suction device 17 for conveying airflow and removed material through a conduit 18 from the nozzle assembly 12 to a treatment zone within the vehicle, the treatment zone having a separation means 19 for accumulating removed material, a means 20 for conveying the airflow from the separation means to the suction device 17, and a means 21 for conveying the removed material to a storage zone (not shown).

In the preferred embodiment the vehicle 15 is a truck with a cab 16 for the driver and the driving controls. Mounted inside the body of the truck is a water reservoir storage tank 11 connected to an ultra high-pressure/low-volume pump (not shown) capable of expelling water from the storage tank at a pressure from 35,000 psi and preferably starting at 40,000 psi (2,800 bar) and approximately 3.5 to 4.5 liters per minute. Let it be known that the volume of water relates to the nozzle orifice size and not to the number of nozzles fixed to a given nozzle carrier. This means that the mass or force of water through each nozzle remains within the required parameters yet the volume of water and size of the nozzle carriers are able to increase, thus more water is supplied although the dynamic force remains within parameters. Such a UHP/LV pump is available from Flow International Corporation. The exact water pressure and volume used during operations can be adjusted depending upon the material being removed. An ultra high-pressure hose (also not shown) connects the pump with the water blasting device.

The use of ultra high-pressure/low-volume water has significant advantages compared with high-pressure/high-volume water blasting systems. The ultra high-pressure means that the water leaves the nozzle assembly of the water blasting device 12 at a greater speed (about Mach 2). Just prior to the point of exit (pressure converts to velocity) it is deemed desirable to have lowered the water (fluid) temperature to approximately 9° C. and this will be a device embodied within the gun application system. There will as well be a support system (cooling device) embodied within the main structure of the complete turnkey package. This is a desirable water temperature for cutting and removing bitumen from the surface of a road because bitumen loses its adhesive properties as the temperature of its surroundings decreases below 14° C. It has been ascertained that water rated at 40,000 psi and upwards is compressed—this in turn considerably lowers the freezing point of the water below 0° Centigrade. It is envisaged that the gun and nozzle system will be developed to transfer the required minus temperature into the compressed water prior to the UHP water conversion from pressure to velocity (through the nozzles) thus when the conversion (pressure×velocity) takes place the high velocity water will carry a temperature range below freezing point but will remain liquid—the basis of this function is to inject the bitumen with super cool liquid thus stabilising the bitumen into a deep non adhesive and solid state. The use of low volume water is beneficial because it moves relatively slowly within the enclosed UHP pressure system thus giving time for the minus temperature influence to establish itself before the fluid converts to velocity. Additionally, too much water can cause damage to the underlying base of the road. The reduced need for water also means that the truck 15 can carry a full working day's supply without the need to refill the storage tank 11.

It is considered that at the point of conversion (pressure× velocity) that hypothetically (by the laws of thermodynamics) the fluid (water) may reach an even lower minus temperature than what is introduced as previously explained.

The nozzle assembly of the water blasting device 12, containing at least one nozzle 13, is supported by a mobile carriage 22 which is driven along a linear track 14 by an electric, pneumatic or hydraulic motor 23. The linear track 14 is horizontally mounted across the front width of the truck 15 and the movement of the carriage 22 is controlled by a microprocessor which coordinates the movement of the carriage with the forward/rearward travel of the truck to control the rate at which the nozzle assembly of the water blasting device 12 moves across the width of the road as the truck moves along the length of the road. An electronic (or otherwise) surveillance system will read the road surface and ascertain the standard of treatment required and then automatically command the complete application/function ensuring a standard is met and recorded. For example, video cameras may be positioned to film the road surface before and after treatment, with the two images being transmitted to a split-screen display inside the cab of the truck so that the driver can view the operation without leaving the cab. The addition of one or more lights configured to illuminate the road surface at the blasting zone allows the surveillance system to function at night. The nozzle assembly of the water blasting device 12 is surrounded by a purpose-built shroud 24. The roof of the shroud contains two suction inlet ports 25 and 26 through which a mixture of air, water and released bitumen enter due to the action of a suction pump 17 connected to the inlet ports.

The mixture of air, water and released bitumen is carried through a bifurcated transfer pipe 18 from the suction inlet ports 25 and 26 to a separation and condensation device 19 inside the truck 15. The separator/condenser contains two chambers, an upper chamber 60 and a lower chamber 61. The air leaves the separator/condenser through an aperture 20 in the upper chamber 60 and passes through an assessment device 27 before reaching the suction pump 17. The water and released material either accumulate in the upper chamber 60 and enter the lower chamber 61 when a valve is opened between the two chambers, or in the event that the valve 62 is open, pass through the valve and accumulate in the lower chamber.

The lower chamber 61 contains a swinging flap valve 21 through which the water and released material drain out of the separator/condenser. The two valves 62 and 21 are controlled by a microprocessor so that when one valve is open the other valve is closed. This allows the separator/condenser 19 to accumulate water and released material in the upper chamber 60 at the same time as water and released material drains from the lower chamber 61.

Bitumen becomes extremely adhesive when subjected to heat. On a hot day, the temperature of bitumen on a road can be greater than 60° C. The applicant has made the surprising discovery that bitumen at this temperature does not adhere to particular materials, such as silicone. The non-adhesion to the material is thought to be caused by the 'Lotus effect' whereby bitumen on the surface of the material wants to form spherical shaped particles due to the factors of adhesion and cohesion. Silicone is thought to be strongly susceptible to the 'Lotus effect' which is more of a mechanical action than a chemical action. The surfaces of the apparatus that are likely to come into contact with bitumen are either made from or coated in a material which contributes to the 'Lotus effect' on bitumen. In the preferred embodiment the surfaces of the apparatus that come into contact with bitumen are either made from silicone, for example, a very hard (95 shore) silicone putty sold under the trademark ZETALABOR™ (Zhermack SpA), or are coated in silicone, for example, a silicone based paint manufactured by Hempel A/S or a silicone based liquid composition manufactured by Dow Corning (3110 RTV). The silicone based paint is especially preferred because of its superior bitumen rejection qualities and its 'anti-slumping' properties.

The individual features of the apparatus are described in greater detail below.

1. Linear Track and Carriage

The carriage 22 can move along the track 14 in a number of different ways, for example, using a caterpillar track arrangement whereby a Gates type double sided drive belt connects two or more pulleys on one, or each, side of the track containing corresponding track grooves; or by a rack and pinion system whereby a pinion is fitted into the centre of a roller wheel and the rack is inlaid into the track. In the preferred embodiment described below, the carriage moves along the track due to a friction drive.

Figure 3:
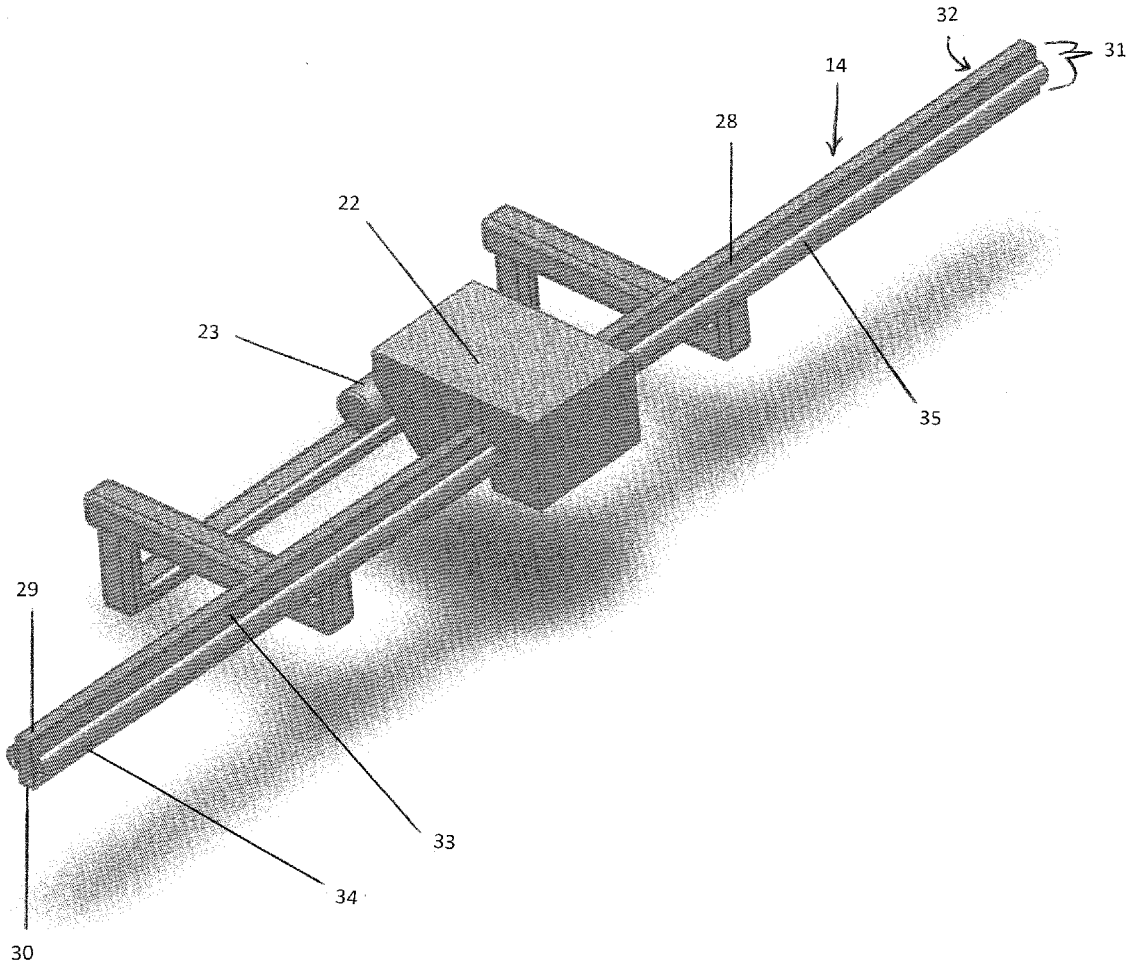
FIG. 3 is a perspective view of a linear track and carriage of the apparatus of FIG. 1.
Figure 4:
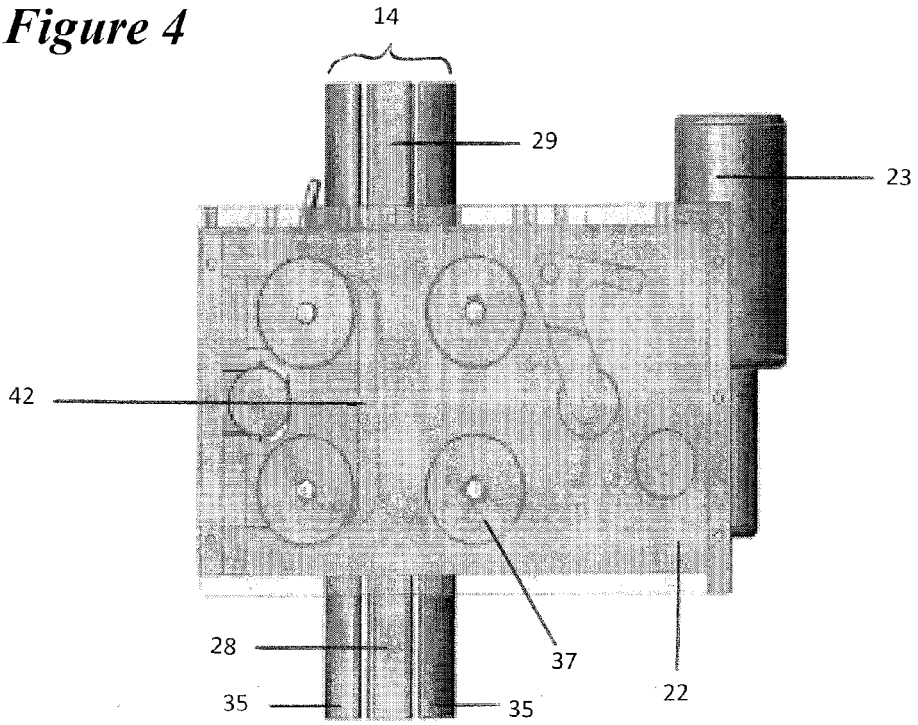
FIG. 4 is a plan view of the carriage of FIG. 3 showing the internal structure of the carriage.
Figure 5:
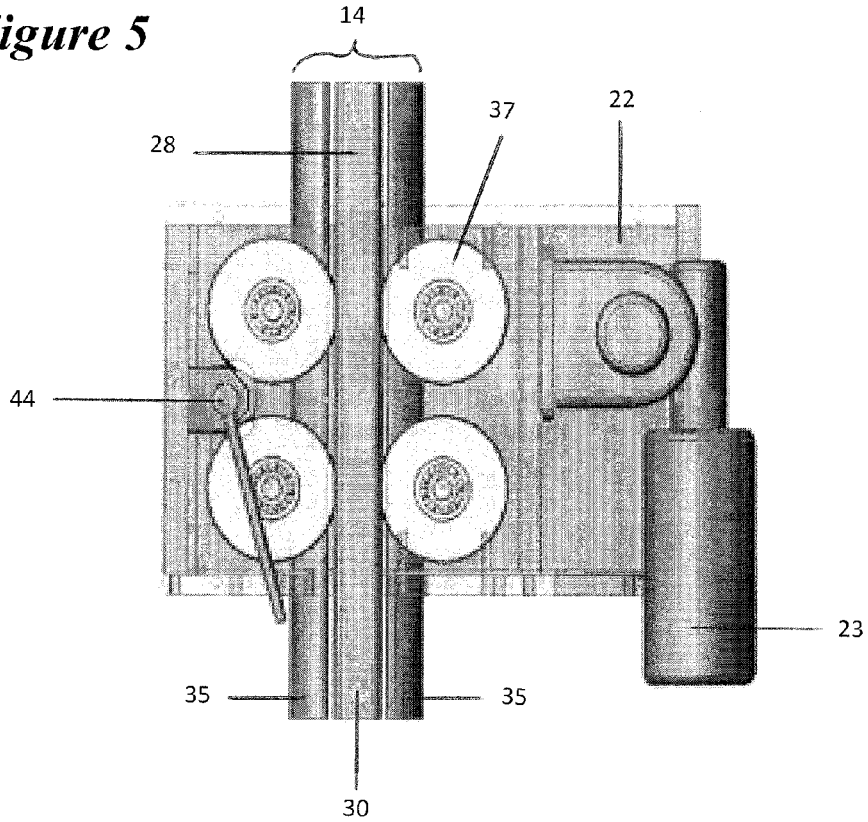
FIG. 5 is a rear view of the carriage of FIG. 3 showing the internal structure of the carriage.
Figure 6:
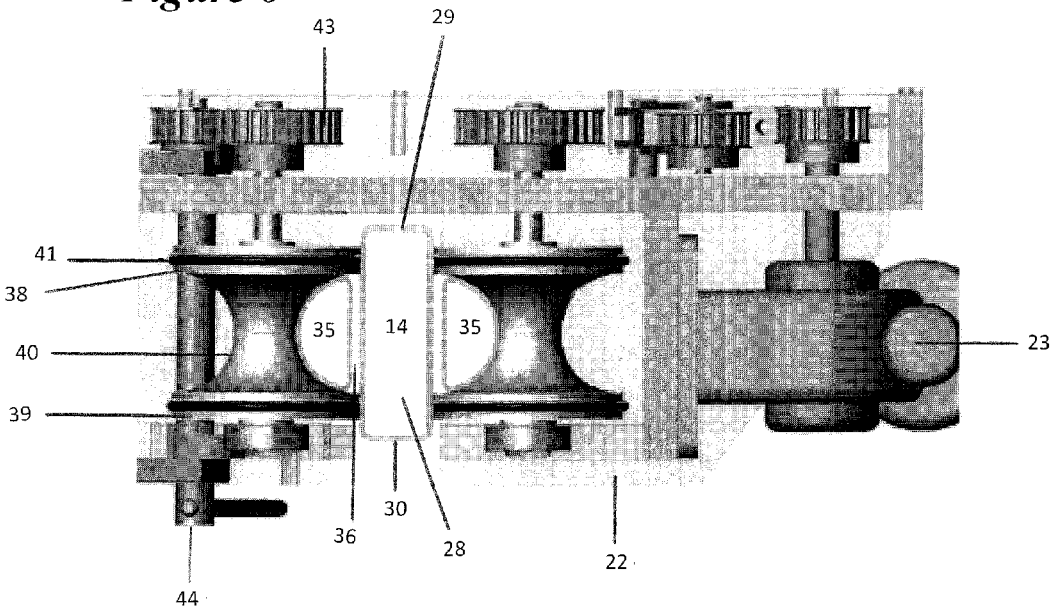
FIG. 6 is a left side view of the carriage of FIG. 3 showing the internal structure of the carriage.
Figure 7:
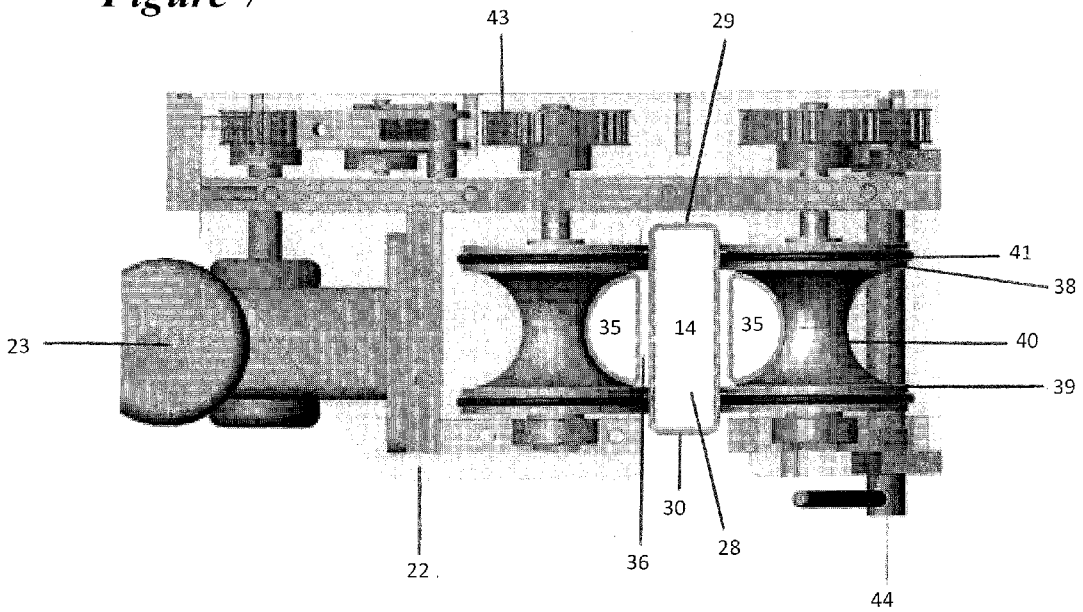
FIG. 7 is a right side view of the carriage of FIG. 3 showing the internal structure of the carriage.
Figure 8:
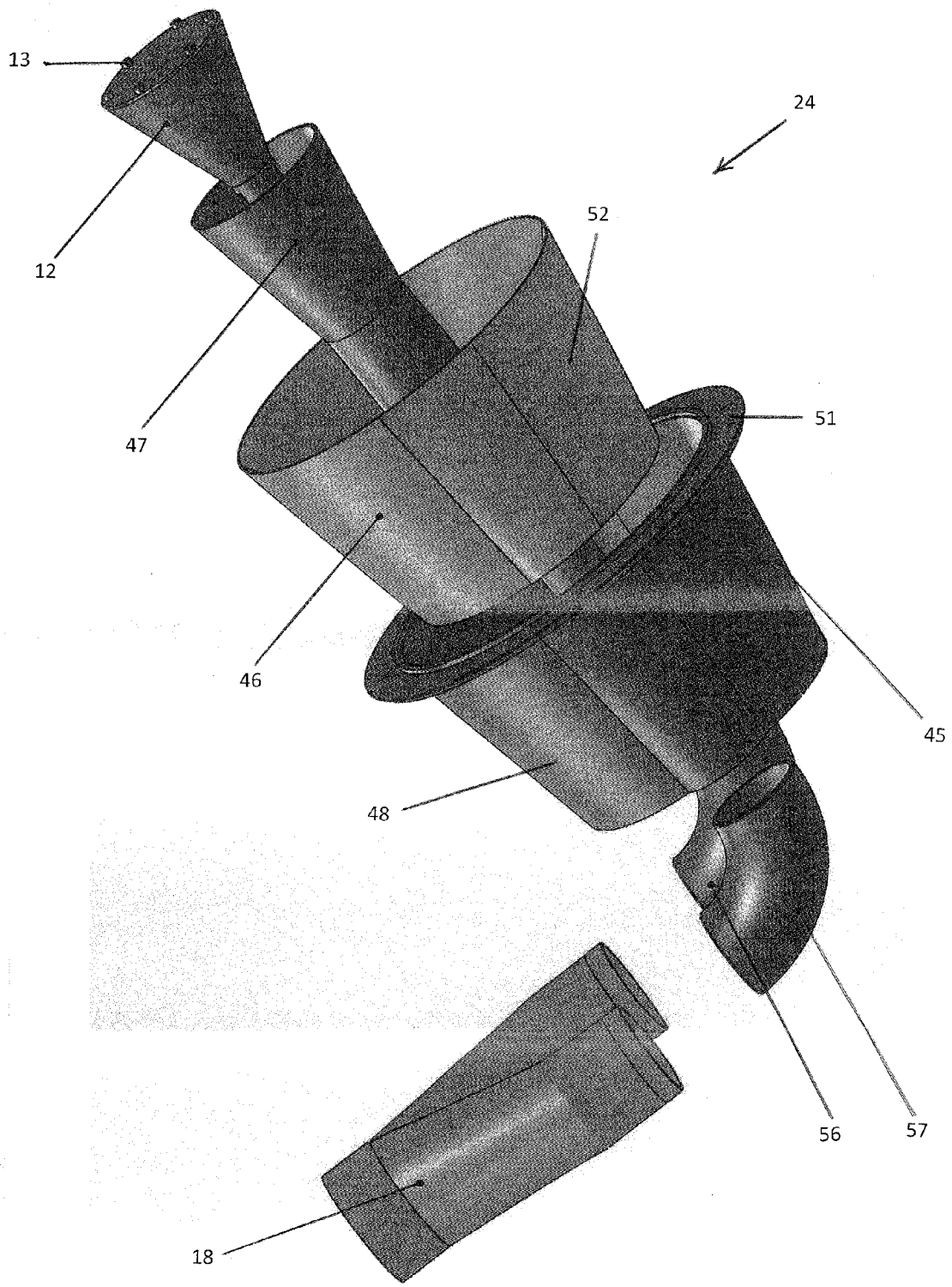
FIG. 8 is an exploded view of the shroud of the apparatus of FIG. 1.
Figure 9:
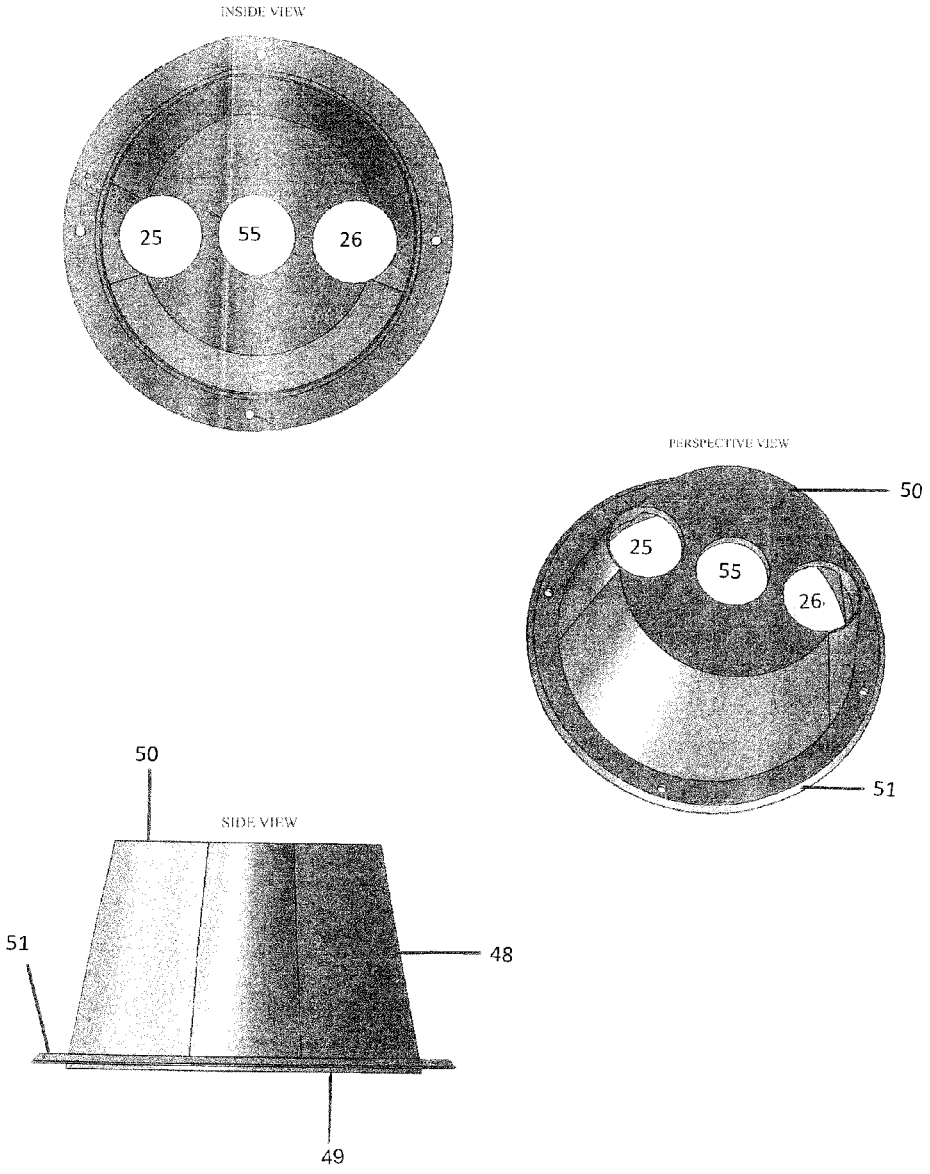
FIG. 9 is a set of views of the external housing in the shroud of FIG. 8.
Figure 10:
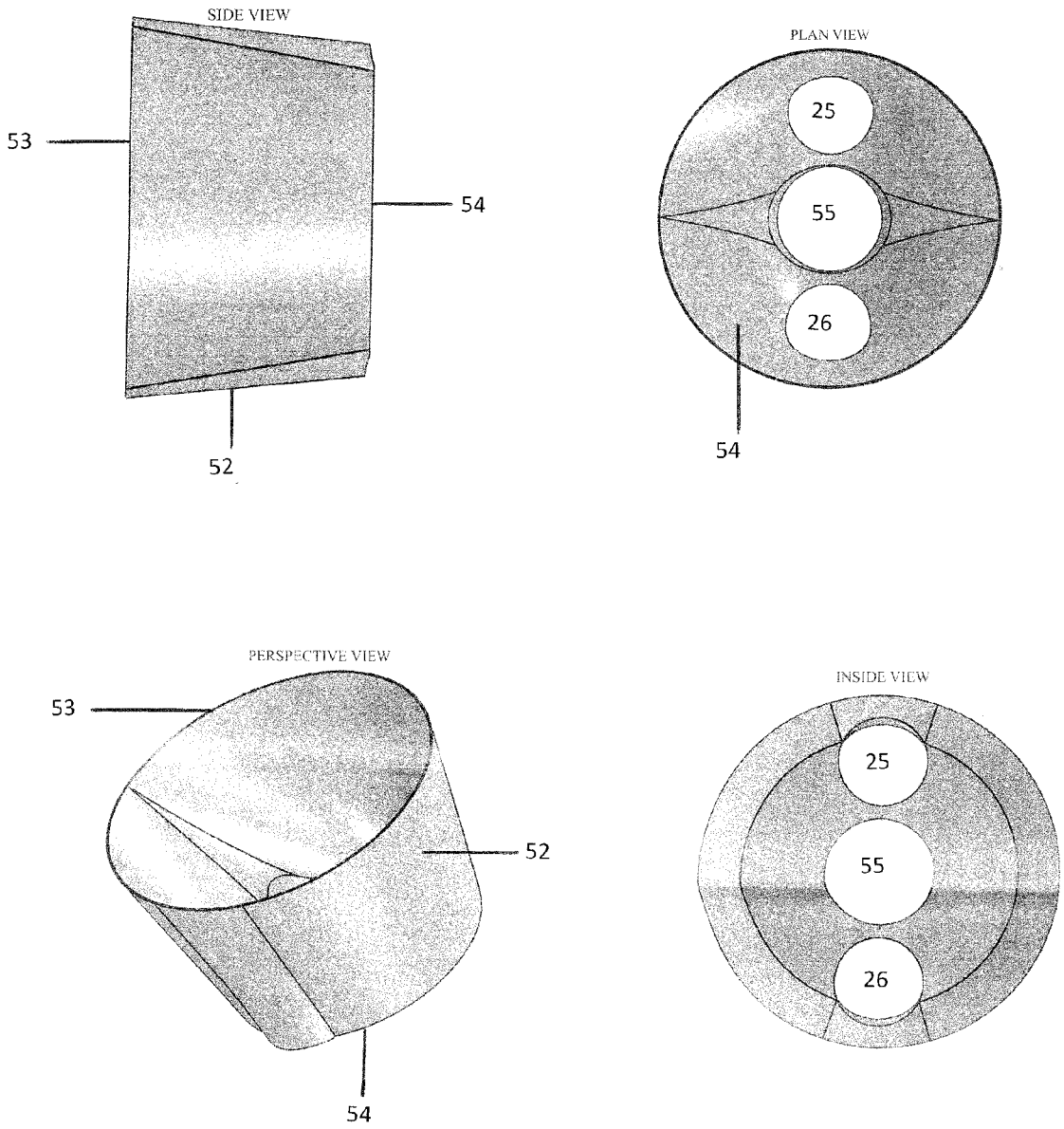
FIG. 10 is a set of views of the insert in the shroud of FIG. 8.
Figure 11:
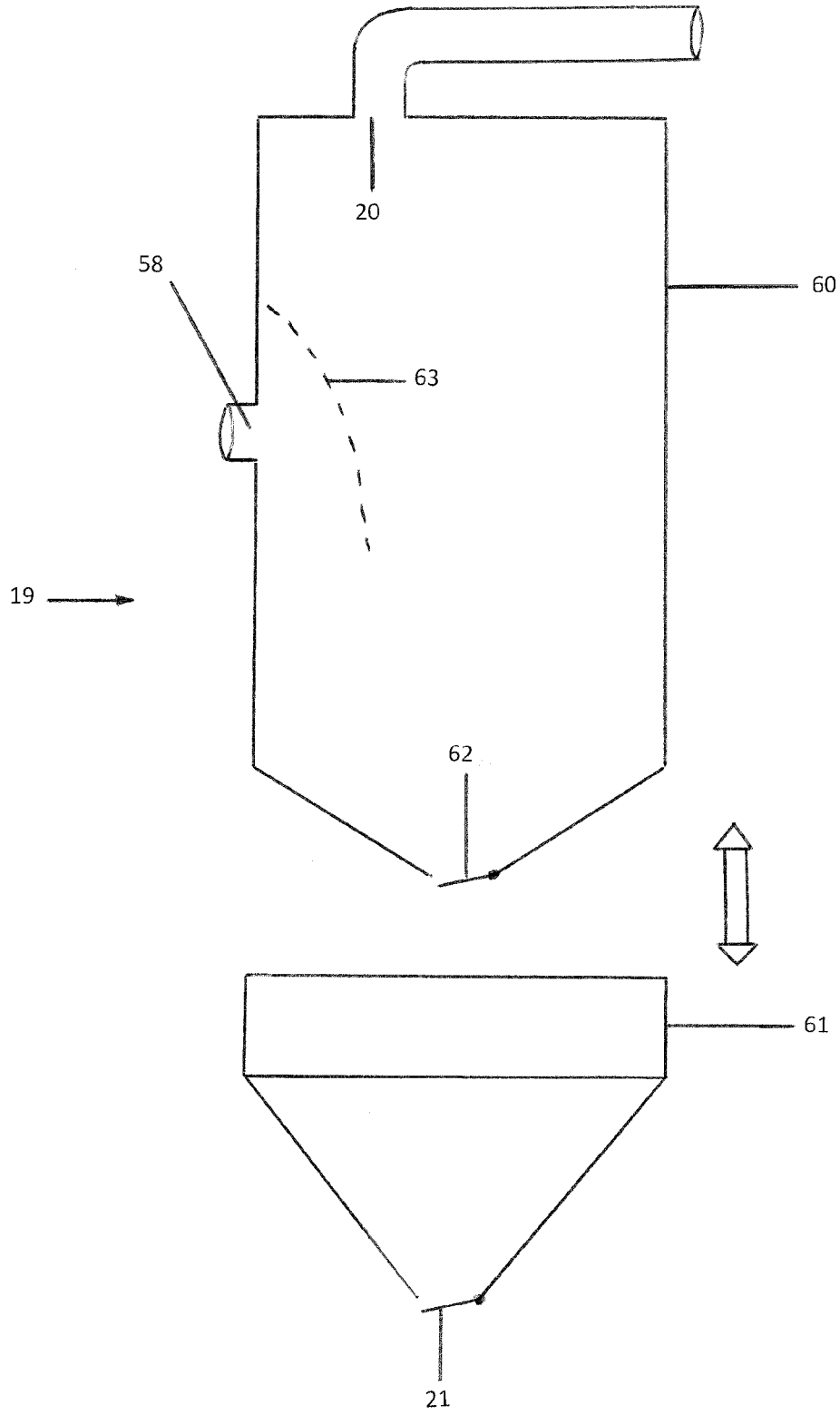
FIG. 11 is an exploded view of the separation and condensation device of the apparatus of FIG. 1.
Figure 12:
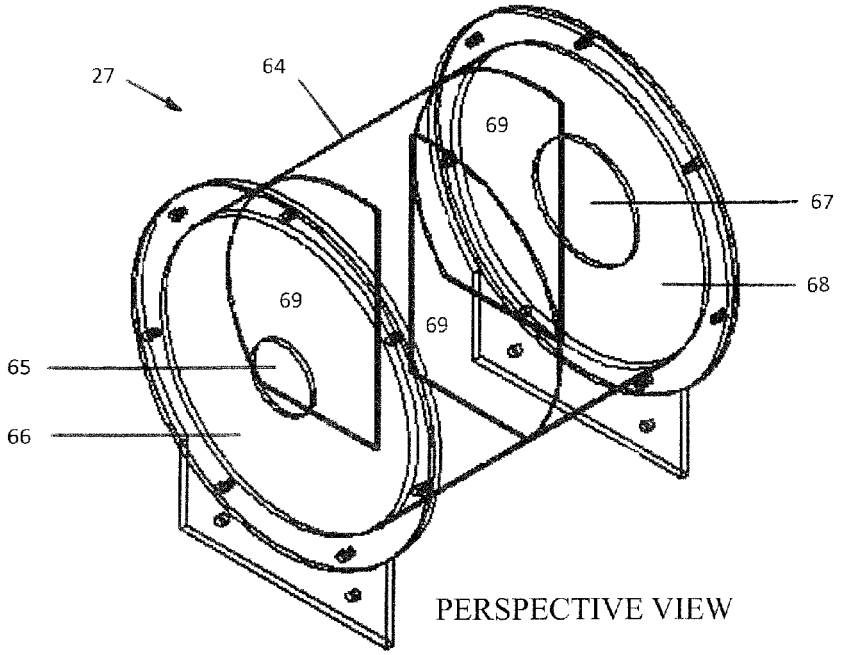
FIG. 12 is a set of set of views of the assessment device of the apparatus of FIG. 1.
Figure 12:
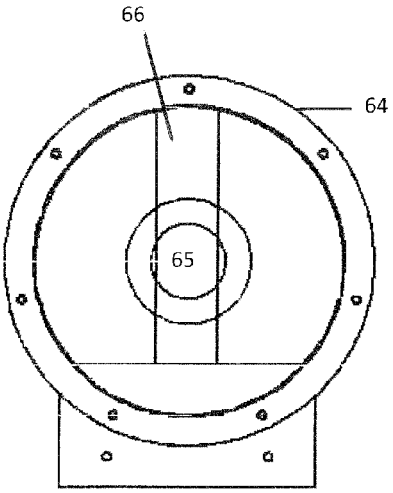
Figure 12:
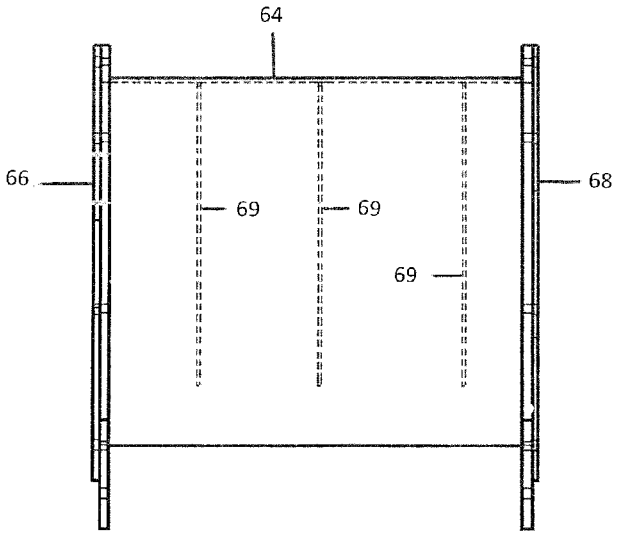

FIG. 3 shows a box shaped carriage 22 arranged for movement along a linear track 14. The track consists of a stainless steel RHS (Rectangular Hollow Section) beam 28 with an upper edge surface 29, a lower edge surface 30, and first and second opposed lateral surfaces 31 and 32. Each lateral surface presents two elongate drive regions 33 and 34 extending substantially the length of the track 14. On each side of the track, the drive regions 33 and 34 are separated by a stainless steel D-shaped beam 35. Each D-shaped beam is attached to one side of the RHS beam 28 via a spacer 36. The spacers assist in keeping the track 14 dry and clean by allowing most of the liquid or material on the track to fall or pass through the gaps created by the spacers between the RHS beam 28 and the D-shaped beams 35 causing the track to dry or clear reasonably quickly.

The carriage 22 houses two roller elements 37 on opposite sides of the track 14. Each roller element has a generally hourglass shape with substantially cylindrical end parts 38 and 39 connected by a concave central region 40. When the concave central region of the roller element is engaged with the D-shaped beam 35 on one side of the track 14, the two end parts of the roller element 38 and 39 are engaged with the elongate drive regions 33 and 34 on the same side of the track.

The roller elements 37 are made using a CNC lathe with a hole drilled through the axis of rotation to allow attachment to the carriage 22 and grooves lathed out of the middle of each of the end parts 38 and 39 to allow O-rings 41 to be fitted around the circumference. O-rings allow the roller element 37 to make better contact with the RHS beam 28 and increase the stability of the carriage 22. O-rings 41 also increase the friction between the roller element 37 and the track 14 which means that more force is required to move the carriage 22 and therefore increases the likelihood that the roller elements will roll rather than slide. This is particularly the case with softer grade O-rings, for example, N70 O-rings compared to N90 O-rings, which deform more when force is applied to them creating a greater area of contact.

A standard 12-24V electric motor 23 and a drive belt 42 at the top of the carriage 22 drives two of the four roller elements 37 and causes the rollers to roll along the linear track 14 in either a forwards or backwards direction. However, in an alternative embodiment, there can be two separate drive belts, one at the top and the other at the bottom of the carriage, each driving a pair of roller elements in one direction rather than having only one drive belt driving the rollers in either direction. The drive means uses an arrangement of pulleys 43 and tensioners with the belt 42 wrapped around the pulleys to create the drive system. The tensioners are preferably made out of metal, such as aluminium or steel, rather than plastic so that the tensioners do not flex under loading.

A feature of the drive belt design is that the spacing between the two sets of opposed roller elements 37 on each side of the carriage 22 can be adjusted by a lever system. The lever 44 can be used to turn an eccentric shaft in order to move one side of the carriage 22 towards the track 14 and thus cause a clamping effect. The lever 44 increases the performance of the system because, using the lever, the carriage 22 can be removed from the track 14 allowing any dirt or debris on the roller elements 37 to be removed with ease, thereby creating better rolling conditions for the carriage. The walls of the carriage 22 act as mounting points for attaching the nozzle assembly of the water blasting device 12.

2. Shroud

The shroud 24 is made of a suitable material, such as steel or silicone putty sold under the trademark ZETALABOR™ (Zhermack SpA), and consists of an external housing 45, an insert 46, and an inner housing 47 to support the nozzle assembly of the water blasting device 12. The shape of the external housing 45 generally resembles a top hat and comprises a cylindrical structure 48 with an open end 49 and a closed end 50; the open end having an outwardly extending annular rim 51. The insert 46, which fits inside the external housing 45, is a correspondingly shaped cylindrical structure 52 with an open end 53 and a closed end 54. The closed ends 50 and 54 of the insert 46 and the external housing 45 both contain apertures 55 that cooperate, once the insert and the housing are engaged, to form an opening for the nozzle assembly of the water blasting device 12, as well as apertures that cooperate to form two suction inlet ports 25 and 26 for the entry of air, water and material released from the road surface. The inner housing 47 can rotate the nozzle assembly of the water blasting device 12 at an adjustable rpm speed and either increase or decrease the distance between the nozzle assembly and the road surface.

The rim 51 of the shroud 24 disrupts the direction of the airflow before it enters the shroud to ensure that the air does not enter the shroud in a linear manner. The shroud 24 is mounted onto the carriage 22 in such a way that the rim 51 is kept at a constant height, for example 15 mm, above the surface of the road in order to maintain an optimum air seal.

The interior surfaces of the cylindrical structures 48 and 52 are shaped into two zones; a first zone and a second zone. In the first zone, which is located close to the open ends 49 and 53, the walls of the cylindrical structures 48 and 52 are substantially perpendicular to the rim 51 so as to create lift for the mixture of air, water and released material. In the second zone, located close to the closed ends 50 and 54, the walls of the cylindrical structures 48 and 52 are angled towards the suction inlet ports 25 and 26 so as to direct the mixture into the inlet ports.

The surfaces of the shroud 24, including the rim 51, are coated in a silicone based paint (Hempel A/S) to prevent material such as bitumen adhering to the surfaces. In the event of a blockage, the shroud 24 can be opened to allow the interior to be more easily cleaned by the operator.

3. Transfer Pipe

The two suction inlet ports 25 and 26 are connected to the separator/condenser 19 by a bifurcated steel pipe 18. At the bifurcated end of the pipe the two divisions of the pipe 56 and 57 are curved at an angle of 45° before engaging with the two suction inlet ports 25 and 26. The curved nature of the two divisions of the pipe 56 and 57 combined with the high velocity of the mixture of air, water and released material has a 'chisel' effect on the material.

The pipe 18 is comprised of two half sections with a lockable hinge member located within the wall of the pipe. This allows the pipe to be opened and easily cleaned by the operator in the event of a blockage. The interior of the pipe is also coated in a silicone based paint (Hempel A/S) to discourage material such as bitumen adhering to the inside of the pipe. The outside of the pipe is covered with a 'heat sink' material, such as a water jacket, in order to reduce the temperature inside the pipe and decrease the adhesive properties of the material travelling through the pipe.

4. Separation and Condensation Device

The separation and condensation device 19 consists of two chambers, an upper chamber 60 and a lower chamber 61. The upper chamber 60 has a hollow rectangular or cylindrical cross-section, a cone shaped base, and a roof. The transfer pipe 18 delivers the mixture of air, water and released material into the upper chamber 60 through an inlet 58 located in one of the walls of the chamber. The interior of the upper chamber contains a curved barrier 63 which extends from the wall above the inlet 58 to a position in the interior of the chamber below the inlet. An aperture 20 is located in the roof of the upper chamber 60 to allow for the release of air from the chamber. A valve 62 is located in the cone shaped base of the upper chamber 60 to allow for the release of accumulated material and water from the upper to the lower chamber.

The lower chamber 61 is located underneath the upper chamber 60 and has a hollow rectangular or cylindrical cross-section and a cone shaped base. The base of the upper chamber, including the valve 62, forms a roof for the lower chamber. The base of the lower chamber 61 contains a valve 21 for the release of water and material. The valves 62 and 21 in the base of each chamber are opened or closed by an air ram (or a suitable electromagnetic or hydraulic device) which is controlled by a microprocessor to ensure that when one valve is open the other valve is closed.

The interior walls of each chamber 60 and 61 as well as the deflector 63 are coated with a silicone based paint (Hempel A/S) to ensure that material such as bitumen does not adhere to the interior surfaces. After entering the upper chamber 60, the material and water strike the deflector 63 and, due to the silicone based paint and the curved nature of the deflector, are directed towards the cone shaped base of the upper chamber.

The air that enters the upper chamber 60 through the inlet 58 also strikes the deflector 63 but is able to rise and leave the chamber through the aperture 20 in the roof of the chamber. The deflector is made cold by the impact of the material and water which causes the deflector to collect condensation and remove water vapour from the airflow. An additional cooling system for reducing the temperature inside the separation chamber 19 can also have a beneficial effect in removing water vapour from the airflow. The volume of the separation chamber 19 is much greater than the volume of the transfer pipe 18. Accordingly, there is a substantial decrease in airspeed from the transfer pipe 18 (160-170 km/hour) to the separation chamber 19 (2-3 km/hour).

The water and accumulated material lie at the bottom of the upper chamber 60 if the valve 62 in the base of the upper chamber is closed and drain into the lower chamber 61 when the valve is open. If the valve 62 is open, during operation the water and released material will pass through the valve and directly enter the lower chamber 61. The water and accumulated material are then stored inside the lower chamber 61 and the valve 62 will close isolating the two chambers and allowing the upper chamber 60 to remain operational in the main recovery mode. Then the swinging flap valve 21 in the base of the lower chamber 61 is opened to the atmosphere. The opening of the swinging flap valve 21 is triggered by the lower chamber 61 being filled with water and released material. An open, porous sack is positioned underneath the swinging flap valve 21 and collects the material and water as it passes through the valve. A new sack is automatically opened and moved into position by a trolley arm approximately every 10-20 minutes during the operation of the apparatus. As the sack is porous and released material does not mix with water, the water passes through the sack and leaves the material inside. Underneath the sack is a stainless steel tray which collects the water so that it can be recycled and returned to the water reservoir storage tank 11. The ability to recycle the water is advantageous and allows a smaller water reservoir storage tank to be carried. For example, a 400 L tank with a UHP/LV pump that expels water at a rate of 4 liters/min will last approximately 1.5 hours before it needs to be refilled. However, if the water is recycled to the tank, the same tank can be used for the duration of the day. The recovered water can be filtered to remove any solids before being returned to the water reservoir storage tank, for example, using evaporative cooling or a centrifuge. The bitumen filled sacks are left by the side of the road for later collection.

5. Assessment Device

After the airflow leaves the separator/condenser 19 via the aperture 20, it travels through a rigid split pipe or flexible hose 59 (which can be coated in an anti-adhesion product) to the assessment device 27 to remove any remaining water vapour from the air before the air reaches the suction pump 17. The assessment device 27 is a hollow steel vessel 64 having two closed ends 66 and 68, with an air inlet 65 located in the first closed end 66 and an air outlet 67 located in the second closed end 68. A two position valve (circuit/atmosphere) may be mounted to the inlet end of the vessel 64. The vessel can be cylindrical, square or rectangular. Between the air inlet 65 and outlet 67 there are one or more panels 69 inside the vessel 64 to divert the passage of the airflow. In the preferred embodiment, the vessel 64 is cylindrical and contains three panels 69. The outer walls of the vessel 64 are cooled by the surrounding ambient air and the panels 69 inside the device collect condensation from the warmer airflow entering the device from the separator/condenser 19. The water collected at the base of the vessel 64 leaves the device through an automated gated valve to be recycled for use in the water reservoir storage tank 11. Although the airflow should no longer contain any released material, any particles of material present in the airflow should also be prevented from reaching the suction pump 17 by the panels 69. The assessment device 27 can be artificially heated or cooled to improve the efficiency of the whole apparatus. If the outlet section of the assessment device 27 is cooled, the device becomes a more efficient condenser, raises the efficiency of the suction pump 17 and ensures that the suction pump does not overheat.

Due to the panels 69 inside the vessel 64, the speed of the airflow passing through the device is greatly reduced and the slower airspeed allows details of the airflow to be accurately measured. The inlet side of the assessment device 27 is fitted with sensors for measuring pressure, temperature, moisture and airflow fluctuations, as well as a microprocessor, such as a computer, or monitoring gauges to compare the measurements taken from the sensors with normal ranges in order to determine temperature requirements for condensing and suction pump efficiency or to determine whether a blockage has occurred within the system as a whole. If the microprocessor determines that a blockage has occurred, it can alert the operator in the cab 16 and, if necessary, deactivate the suction pump 17 and/or reduce the pressure in the system via a pressure release valve housed in the assessment device 27. A further option is to activate a 'self-cleaning' mechanism in which a shock is sent through the flexible hose 59 in an attempt to clear the blockage.

6. Suction Pump

The suction pump 17 is a side channel pump (regenerative blower), namely, the HRB 900 manufactured by Republic Blower Systems. This pump has the advantages of being low maintenance, operating at a low noise level (60-85 dB), and having a high resistance to any airborne particles, such as sand. As the entire flow path from the shroud 24 to the pump 17 is an essentially 'open' system, high vacuum pressures are not developed. This means that individual parts, such as the separator/condenser, can be made from relatively thin, lightweight material and thus the overall weight of a vehicle fitted with the apparatus is minimised.

There are many applications for the apparatus of the disclosure. One desirable application is in the hydroblasting industry. Typically ultra high-pressure water blasters have been operated manually. However, concerns about the health effects of this on workers have meant that there are benefits in operating the process by remote control. In the embodiment described, the linear track is welded to the front of the truck and the carriage with the water blaster attached is operated from inside or outside the cab of the truck to remove bitumen or road markings from roads. The microprocessor may coordinate the movement of the carriage with the forward/rearward travel of the vehicle, for example, to control the rate at which the nozzle assembly of the water blasting device moves across the width of the road as the vehicle moves along the length of the road.

While some preferred aspects of the disclosure have been described by way of example, it should be appreciated that modifications and/or improvements can occur without departing from the scope of the disclosure as set out in this specification.

The terms comprise, comprises, comprising, or comprised, if and when used herein, should be interpreted non-exclusively, that is, as conveying "consisting of or including".

What is claimed is:

1. A vehicle mounted apparatus for high-pressure fluid blasting to remove material from or otherwise treat a surface, the apparatus comprising: a high-pressure fluid supply connected to a nozzle assembly containing at least one nozzle, the nozzle assembly being supported for movement along a track mounted transversely on the vehicle and surrounded by a shroud having one or more suction inlet ports for the entry of air, fluid and released material, the shroud comprising an external housing, an insert and an inner housing, the external housing comprising a cylindrical structure with an open end and a closed end, the open end having an outwardly extending annular rim, the insert comprising a correspondingly shaped cylindrical structure with an open end and a closed end, the closed ends of the external housing and the insert both containing apertures that cooperate, once the insert and the external housing are engaged, to form an opening for the inner housing supporting the nozzle assembly, as well as apertures that cooperate to form one or more suction inlet ports; and a suction device for conveying an airflow and removed material through a conduit from the nozzle assembly to a treatment zone within the vehicle, the treatment zone having a separation means for accumulating removed material, a means for conveying airflow from the separation means to the suction device, and a means for conveying the removed material to a storage zone.

2. An apparatus according to claim 1, wherein the shroud has an open end and a closed end, the open end having an outwardly extending annular rim.

3. An apparatus according to claim 1, wherein the shroud and the nozzle assembly are configured to rotate at an adjustable rpm speed.

4. An apparatus according to claim 1, wherein the shroud is configured to allow the distance between the nozzle assembly and the surface being blasted to be adjusted.

5. An apparatus according to claim 1, wherein the nozzle assembly is for use in blasting the surface of a road or other paved surface, the track being mounted along the width of a road vehicle with the nozzle assembly attached to the carriage.

6. An apparatus according to claim 1, wherein the conduit comprises at least one pipe consisting of two half sections with a lockable hinge member located within the wall of the pipe to assist in the removal of any blockage.

7. An apparatus according to claim 1, wherein interior surfaces of the shroud are shaped to form at least a first zone and a second zone.

8. An apparatus according to claim 7, wherein the first zone is located close to the open end of the shroud, the interior walls of the shroud in the first zone being substantially perpendicular to the rim to create lift for the mixture of air, fluid and released material, the second zone is located close to the closed end of the shroud, the interior walls of the shroud in the second zone being angled towards the one or more suction inlet ports to direct the mixture into the one or more ports.

9. An apparatus according to claim 1, wherein the nozzle assembly is supported by a carriage for movement along the track.

10. An apparatus according to claim 9, wherein the carriage moves along the track by means of a friction drive, caterpillar track, or rack and pinion.

11. An apparatus according to claim 10, wherein the movement of the carriage along the track is controlled by a microprocessor in order to control the direction and/or speed of the carriage.

12. An apparatus according to claim 9, wherein the track is linear and comprises an upper edge surface, a lower edge surface, and first and second opposed lateral surfaces, each lateral surface presenting two elongate drive regions, each extending substantially the length of the track, separated by a guide element, the carriage supporting at least first and second roller elements to be positioned on opposite sides of the track, the first roller element being adapted in a drive position to engage the first lateral surface and the second roller element being adapted, in the drive position, to engage the second lateral surface, each roller element shaped to provide two drive surfaces separated by a guide surface, the drive surfaces being adapted to cooperate with respective drive regions of the track so that rotation of the roller elements will cause the carriage to move along the track, the guide surface cooperating with the guide element on the corresponding lateral surface of the track; the carriage containing a drive means to drive at least one of the roller elements and a biasing means to move the opposed roller elements between a released position in which the carriage can be removed from the track, and the drive position abutting the track, the carriage providing a mounting surface for the nozzle assembly.

13. An apparatus according to claim 12, wherein each roller element has a generally hourglass shape, having substantially cylindrical end parts connected by a concave central region, with the surface of each cylindrical end part providing a drive surface and the concave portion between the end parts providing the guide surface.

14. An apparatus according to claim 12, wherein the drive means comprises a motor and one or two drive belts.

15. A vehicle mounted apparatus for high-pressure fluid blasting to remove material from or otherwise treat a surface, the apparatus comprising: a high-pressure fluid supply connected to a nozzle assembly containing at least one nozzle, the nozzle assembly being supported for movement along a track mounted transversely on the vehicle; and a suction device for conveying an airflow and removed material through a conduit from the nozzle assembly to a treatment zone within the vehicle, the treatment zone having a separation means for accumulating removed material, a means for conveying airflow from the separation means to the suction device, and a means for conveying the removed material to a storage zone, wherein the separation means comprises a separator containing a first and second separation chamber, each chamber having a hollow rectangular or cylindrical cross section and a cone shaped base with a valve located in the centre of the base, the base of the first chamber forming a roof for the second chamber so that material in the first chamber can pass into the second chamber when the valve between the two chambers is open.

16. An apparatus according to claim 15, wherein the separator contains an inlet located in the first separation chamber which directs the airflow, fluid and removed material at a deflector, and an air outlet connected to the suction device, the deflector comprising a curved barrier which extends from above the inlet to a position in the interior of the chamber below the inlet, the impact with the deflector directing the material and fluid to a collection zone at the base of the first or second separation chamber.

17. An apparatus according to claim 15, wherein the two valves are flap valves which are opened or closed by an air ram and controlled by a microprocessor programmed to open only one valve at a time.

18. An apparatus according to claim 15, wherein the storage zone comprises an open, porous sack for the collection of removed material and fluid from the separation means.

19. An apparatus according to claim 15, wherein the apparatus is for use with ultra high-pressure/low-volume water blasting systems of at least 35,000 psi and between 3.5 and 4.5 liters/minute.

20. An apparatus according to claim 15, wherein the apparatus includes an assessment zone in which water vapour in the airflow is condensed and one or more sensors enable details of the airflow to be monitored.

21. An apparatus according to claim 20, wherein the assessment zone also includes a microprocessor to compare the measurements taken from the one or more sensors with normal ranges in order to determine whether there is a blockage in the apparatus and, if so, activate a pre-programmed response.

* * * * *